United States Patent [19]

Young

[11] 3,984,727

[45] *Oct. 5, 1976

[54] RESONANCE LAMP HAVING A TRIATOMIC GAS SOURCE

[76] Inventor: Robert A. Young, R.R. No. 2, Loretto, Ontario, Canada

[ * ] Notice: The portion of the term of this patent subsequent to Nov. 26, 1991, has been disclaimed.

[22] Filed: Mar. 10, 1975

[21] Appl. No.: 557,120

[52] U.S. Cl. ..... 315/267; 313/180; 313/201; 313/220; 313/224

[51] Int. Cl.[2] ..... H01J 61/26; H01J 61/28; H01J 61/33; H05B 41/24

[58] Field of Search ..... 315/267, 248, 246; 313/220, 174, 201, 180, 224

[56] References Cited

UNITED STATES PATENTS

| | | | |
|---|---|---|---|
| 2,202,101 | 5/1970 | Hasler et al. | 313/201 X |
| 3,055,262 | 9/1962 | Ducati et al. | 313/201 X |
| 3,138,739 | 6/1964 | Farmer | 315/248 |
| 3,170,086 | 2/1965 | Bell | 315/248 |
| 3,230,422 | 1/1966 | Gourber et al. | 315/248 X |
| 3,307,060 | 2/1967 | Molidor | 313/201 X |
| 3,851,214 | 11/1974 | Young | 315/267 |

*Primary Examiner*—Palmer C. Demeo
*Attorney, Agent, or Firm*—John E. Benoit

[57] ABSTRACT

A low power, sealed, optically thin resonance lamp having a controllable chemical decomposition source of a triatomic gas and a chemical getter sink in a sealed RF excited discharge. The discharge occurs in a second, extremely pure gas which is present in great excess over the gas produced by chemical decomposition. Excitation of species whose emission is desired occurs by electron impact or energy transfer from the major species which are, in turn, excited by the electron impact.

24 Claims, 4 Drawing Figures

RESONANCE LAMP HAVING A TRIATOMIC GAS SOURCE

This invention relates generally to resonance lamps and more particularly to self-breakdown gas discharge lamps suitable for excitation by low power, low voltage, radio frequency power.

Such a lamp used as either an oxygen resonance lamp or a hydrogen resonance lamp is described in U.S. Pat. No. 3,851,214, issued Nov. 26, 1974 in the name of the present inventor. These lamps use a source of diatomic gas.

The use of resonance absorption and fluoresence is becoming more important in the field of chemical kinetic research.

Most lamps used to produce resonance radiation of atoms derived from gaseous compounds utilize an AC electrical discharge in a low pressure gas which flows away from the emission direction. Since dissociation must coincide or preceed excitation, it is difficult to obtain bright resonance lamps without absorption within the lamp. Such absorption decreases the sensitivity of measuring devices using resonance lamps, and introduces complications in relating intensity measurements to the concentration of absorbers.

Although non-flowing, sealed resonance lamps have considerable convenience, they are difficult to control since the discharge interacts with the walls of the lamp to either remove or provide constituents.

Accordingly, it is an object of this invention to provide a very intense resonance lamp which emits radiation such that direct detection of the transmitted or scattered radiation, without the intervention of filters or dispersal devices, can be used to measure the concentration of the absorbing species while preserving a Doppler line profile unmodified by absorption within the lamp.

A further object of this invention is to provide a lamp as described above using a source of triatomic gases.

These and other objects of the invention will become apparent from the following description when taken in conjunction with the drawings wherein.

Broadly speaking, the present invention utilizes a controllable chemical decomposition source of parent species and a chemical getter sink in a sealed RF excited discharge. This discharge occurs in a second, extremely pure gas which is present in great excess over the gas produced by chemical decomposition. Excitation of species whose emission is desired occurs by electron impact or energy transfer from the major species which are, in turn, excited by the electron impact.

Figure 1:
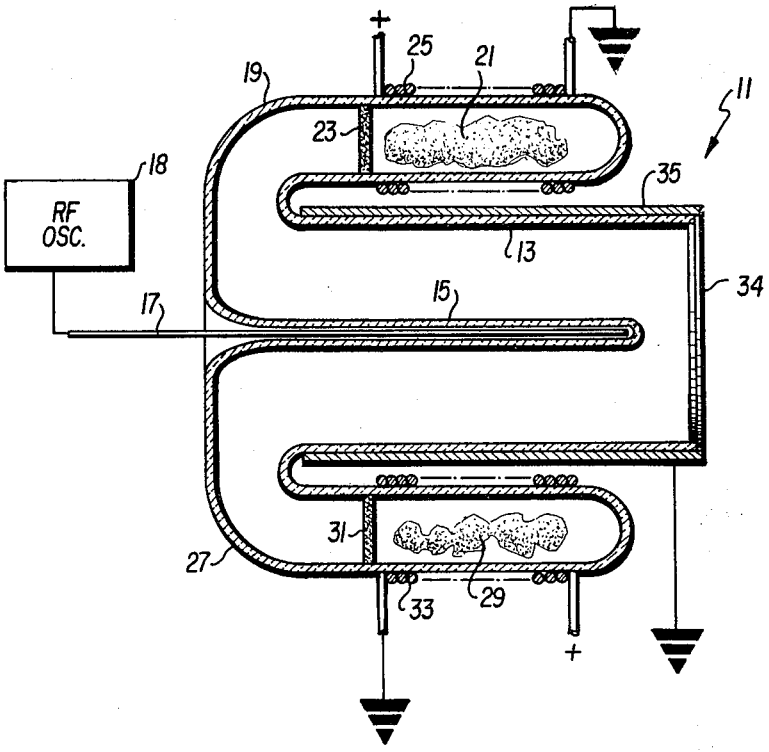
FIG. 1 is a schematic diagram of the tube of the present invention.

Illustrated in FIG. 1 is a vacuum tight cylindrical body 11 having a glass wall 13 and a hollow reentrant element 15. Reentrant element 15 extends coaxially substantially the length of the cylinder. An electrical conductor 17 is contained within the hollow reentrant element and extends outwardly to connect to an RF energy source 18.

A first hollow arm 19 is integral with cylinder 13 and extends outwardly therefrom. The arm is closed at the outer end and is filled with a getter or scavenger 21 such as uranium or a barium containing compound. A gas permeable barrier 23, such as a glass frit, in hollow arm 19 prevents the getter from moving into the cylinder. Heating means 25 here illustrated as an electrical heater, is provided about the arm so as to heat the getter material if necessary.

A second arm 27 also extends from the cylinder and is closed at its outer end. This arm contains the source 29 of the species whose emission is desired. A barrier 31 and a heater 33 are also provided on arm 27.

Cylindrical body 13 is closed at the other end by a window 34 which is transparent to the spectral emission of the species being examined. A special epoxy cement may be required to attach the window to the body of the lamp.

In order to complete the necessary path for electrical excitation, the outside of cylinder 35 may be coated with an electrically conductive material and this coating is grounded as shown. If the cylinder is largely contained within a close fitting, grounded conducting enclosure, a separate coating is not required. In either case, the cylinder is effectively sheathed by a conductive element.

The lamp of the present invention may be used to produce emission of a number of desired species. Examples of this are shown below.

The lamp is subjected to the usual vacuum pump down procedures and the lamp is filled with approximately 1–10 torr of a rare gas such as Argon, Neon, Krypton, Xenon or Helium.

One arm of the lamp is provided with a getter 21 such as Ur or Ba. The other arm is supplied with a source of triatomic gas such as water $CO_2$, $NO_2$, or $SO_2$, for example, from sources 29 such as $CuSO_4.5H_2O$, $BaCl_2.2H_2O$, $BaO_2.8H_2O$, $CaO_2.8H_2O$, $NaSO_4.10H_2O$, or $PbCO_3$, $MgCO_3$, $NaHCO_3$, $ZuCO_3$, $Ba(NO_2)_2$ or $SnSO_4$ and similar compounds.

For operation of the lamp, high purity is essential. The reason for this is believed to be due to the role of the rare gas metastable excited species which builds up in the discharge to a high concentration in the absence of a triatomic gas from the source. With the application of heat to the decomposition source, $H_2O$, $CO_2$, $NO_2$, $So_2$ or other triatomic gases are added and the following representative reaction takes place in the presence of RF excitation at 150 to 600 megahertz.

$$Ar^* + H_2O \rightarrow Ar + OH^* + H$$

$$OH^* \rightarrow OH \text{ and } h\gamma \text{ (desired radiation)}$$

Although the lamp is shown as cylindrical, this particular geometrical configuration is not essential so long as the reentrant portion with the electrode extends coaxially substantially the length of the tube. Further, the lamp body can be of any sufficiently strong, nonporous material such as the illustrated glass or a suitable metal.

Figure 3:
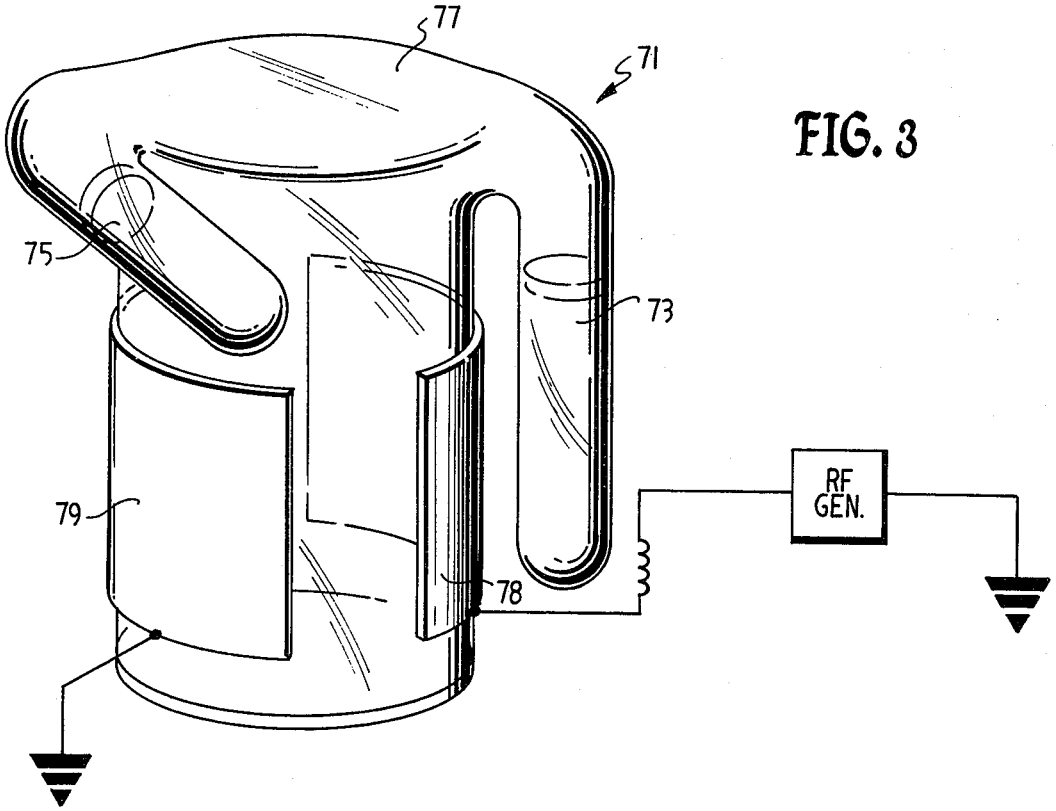
FIGS. 3 and 4 are perspective views of alternate embodiments of the present invention.
Figure 4:
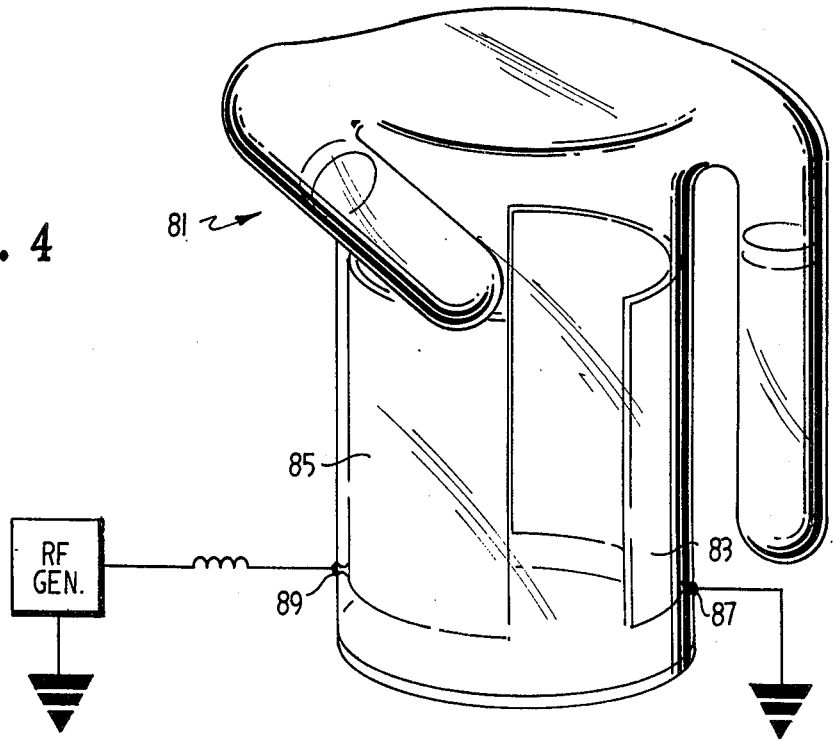

Under some circumstances, it may be desirable to eliminate the central element in the tube. With the central element present, the radiation emanating through the window will include a central black spot, with a resulting donut shaped view. Such a black spot can be avoided by constructing the tube as shown in FIGS. 3 and 4 with the central element eliminated and the exterior electrode split into two electrodes. Thus, there is provided a more uniform discharge.

Figure 2:
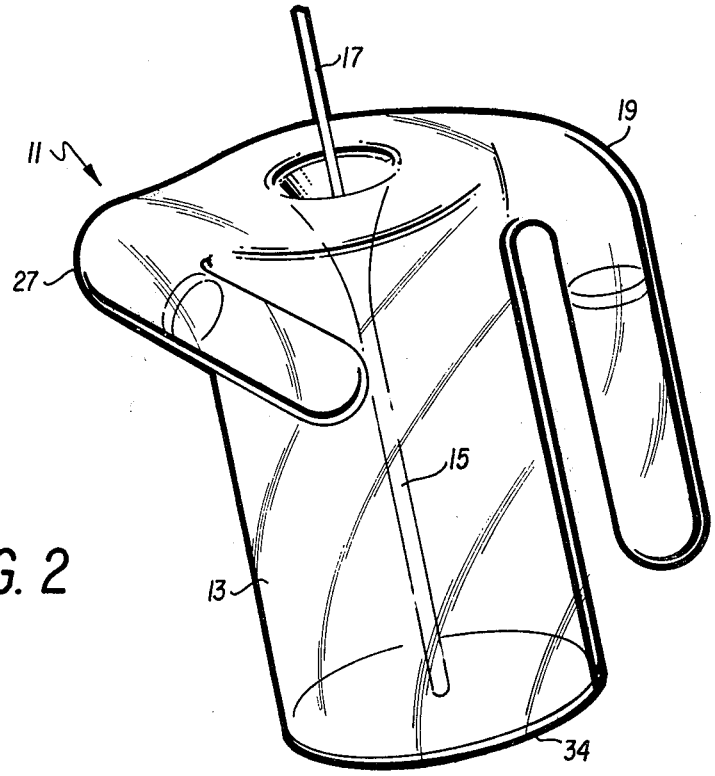
FIG. 2 is a perspective view of a preferred embodiment of the present invention.

The tube 71 of FIG. 3 shows the face 77 opposite the window as being of a continuous substantially flat configuration. Electrodes 78 and 79 are mounted on the exterior of the main body of the tube in opposed relationship. The power is supplied to electrode 78 from the RF generator while electrode 79 is maintained at ground potential. In this tube, the discharge occurs within the tube between the two electrodes. The arms 73 and 75 serve the same purpose as the arms described in FIGS. 1 and 2. The circuit as illustrated acts as a series tuned circuit which includes the RF generator, the coil, and the plate electrodes 78 and 79 which form the capacitive elements of the circuit. Such an arrangement reduces the power requirements for operating the lamp.

FIG. 4 discloses a further configuration of a tube 81. In this embodiment, electrodes 83 and 85 are secured within the main body of the tube and the RF generator is connected to electrode 85 through a glass seal 89. Electrode 83 is also provided with the necessary connection through glass seal 87. In operation, the tube functions the same as the tube of FIG. 3.

The above description and drawings are illustrative only since variations in geometrical constructions and power supply could be varied without departing from the invention. Accordingly, the invention is to be limited only by the scope of the following claims.

What is claimed is:

1. A resonance lamp comprising
a dielectric closed vacuum tight body;
a reentrant coaxial hollow glass element integral within said body and extending from one end thereof substantially the length of said body;
an electrical conductor within said element;
a transparent window at the other end of said body;
two hollow arms integral with and extending from said body;
a high purity rare gas filling within said body at a pressure of 1 to 10 torr;
a source of triatomic gas in one of said arms;
an electrically conductive sheathing adjacent said glass body;
a getter in the other said arm for removing gases from said body; and
means for separately heating each of said arms.

2. The resonance lamp of claim 1 wherein said triatomic gas is $H_2O$.

3. The resonance lamp of claim 1 wherein said triatomic gas is $H_2O$ produced by decomposing $CuSO_4.5H_2O$.

4. The resonance lamp of claim 1 wherein said triatomic gas is $H_2O$ produced by decomposing $CaO_2.8H_2O$.

5. The resonance lamp of claim 1 wherein said triatomic gas is $H_2O$ produced by decomposing $NaSO_2.10H_2O$.

6. The resonance lamp of claim 1 wherein said getter is a barium containing compound.

7. The resonance lamp of claim 1 wherein said triatomic gas is $CO_2$.

8. The resonance lamp of claim 1 wherein said triatomic gas is $CO_2$ produced by thermal decomposition of $ZnCO_3$.

9. The resonance lamp of claim 1 wherein said triatomic gas is $CO_2$ produced by thermal decomposition of $NaHCO_3$.

10. The resonance lamp of claim 1 wherein the getter is uranium.

11. The resonance lamp of claim 1 wherein said triatomic gas is $NO_2$.

12. The resonance lamp of claim 1 wherein said triatomic gas is $NO_2$ produced by thermal decomposition of $Ba(NO_2)_2$.

13. The resonance lamp of claim 1 wherein said triatomic gas is $SO_2$.

14. The resonance lamp of claim 1 wherein said triatomic gas is $SO_2$ produced by thermal decomposition of $SnSO_4$.

15. The resonance lamp of claim 1 further comprising a source of RF power connected to said electrical conductor, and means for grounding said sheathing adjacent the exterior of said body.

16. The resonance lamp of claim 1 wherein said housing is filled with helium.

17. The resonance lamp of claim 1 wherein said housing is filled with argon.

18. The resonance lamp of claim 1 wherein said housing is filled with neon.

19. The resonance lamp of claim 1 wherein said housing is filled with krypton.

20. The resonance lamp of claim 1 wherein said housing is filled with xenon.

21. The resonance lamp of claim 1 used as the capacitive element of a series tuned RF circuit.

22. A resonance lamp comprising
a dielectric closed vacuum tight body;
a transparent window at one end of said body;
two hollow arms integral with and extending from said body;
a high purity rare gas filling within said body at a pressure of 1 to 2 torr;
a source of triatomic gas in one of said arms;
a getter in the other said arm for removing gases from said body;
means for separately heating each of said arms; and
two electrodes in opposed configuration adjacent said body.

23. The resonance lamp of claim 22 wherein said opposed electrodes are mounted to the exterior of said body.

24. The resonance lamp of claim 22 wherein said two opposed electrodes are mounted within said body.

* * * * *